United States Patent [19]

Nunziato et al.

[11] 3,993,013

[45] Nov. 23, 1976

[54] BOAT DOCKING POLE FOR SMALL BOATS

[75] Inventors: Benny Nunziato; Elizabeth Nunziato, both of Bayshore, N.Y.

[73] Assignee: Lawrence Peska Associates, Inc., New York, N.Y. ; a part interest

[22] Filed: Aug. 18, 1976

[21] Appl. No.: 605,766

[52] U.S. Cl. ..... 114/221 R; 114/230

[51] Int. Cl.[2] ..... B63B 21/54

[58] Field of Search ..... 114/230, 221 R; 294/19 R; 43/11, 12; 119/153; 280/11.37 B

[56] References Cited

UNITED STATES PATENTS

| | | | |
|---|---|---|---|
| 2,347,789 | 5/1944 | Nichols | 280/11.37 B |
| 2,800,737 | 7/1957 | Crossan | 43/12 |
| 3,406,651 | 10/1968 | Jalbert | 114/230 |
| 3,760,523 | 7/1971 | Maxwell | 43/11 |
| 3,799,099 | 3/1972 | Conover | 114/221 |
| 3,841,685 | 2/1973 | Kolobziet | 294/19 R |

*Primary Examiner*—Trygve M. Blix
*Assistant Examiner*—Gregory W. O'Connor

[57] ABSTRACT

An extensible telescoping pole device for aid in mooring boats to mooring posts, docks and other objects. It includes a hollow main tubular base section with an attached handle which may be floatable to sustain the pole device if dropped into the water, and has one or more extension tubes which fit one into the other telescopically for extension in length. An outer loop portion which may be annular in shape, is carried on the end of the outermost extension tube to fit over a mooring post for bringing the boat carefully and slowly up to the dock for tying up. The entire device may be made of lightweight metal, or strong plastic tubing, and retractable for easy storage.

3 Claims, 2 Drawing Figures

BOAT DOCKING POLE FOR SMALL BOATS

This invention relates to improvements in pole devices for facilitating the docking and mooring of boats, especially small boats.

SUMMARY OF THE INVENTION

An object of the invention is to provide a novel and improved docking and mooring pole for boats of various sizes, which aids a crewman or even a single owner and operator of a small boat in efficiently docking or mooring his boat.

A further object of the invention is to provide a novel and improved boat docking and mooring aid device by means of which in the form of an elongated pole device, the single crewman or operator of a small boat can easily bring his boat up to a dock or mooring and succeed in tying it up securely to the dock or mooring.

Still another object of the invention is to provide a novel and improved boat docking and mooring aid device, which allows the boat operator to directly engage a dock post which is part of a docking slip in a marina and to draw his boat carefully right up to the post and to tie up thereto, while keeping his boat under control all the time during the operation.

Still a further object of the invention is to provide a novel and improved boat docking and mooring aid device, which is simple in design and construction, which can be made of relatively few parts, and by either manual or mass production methods, and at low cost.

BACKGROUND OF THE INVENTION

In connection with the use of small boats, such as rowboats, sail boats, cabin cruisers, outboard motor boats, and the like, an ever present problem is that of leaving a dock or mooring, and of tying up to a dock or mooring, without difficulty, or in damaging the boat being tied up or any other boats closely adjacent thereto, as in a marina. Where someone is present on the dock, then, someone on the boat can throw a line and have the boat tied up quickly when drawn in by means of the line. However, when there is not another person on the dock, or such person, though present, is not capable of aiding in the docking or mooring of the boat, problems arise, which it is the purpose of this invention to avoid.

This is especially true when the boat is approaching a docking slip, as in a marina, where there are dock posts sunk into the water around the slip, and to which the incoming boat is to be tied up. Where other boats are also using the marina slip, there is usually very little spacing between boats in their respective slip areas, and other boat owners will be watching to make sure that their rub-rails and boats are not damaged by the incoming boat about to be tied up. The present invention makes use of a long pole of special construction, to grab hold of a dock post and thus to control the docking or mooring operation of the boat.

BRIEF DESCRIPTION OF THE DRAWINGS

The foregoing and other objects and advantages of the invenion will become apparent from the following description of a preferred embodiment thereof, as illustrated in the accompanying drawings, forming a part hereof.

In the drawings.

DETAILED DESCRIPTION OF THE PREFERRED EMBODIMENT

Figure 1:
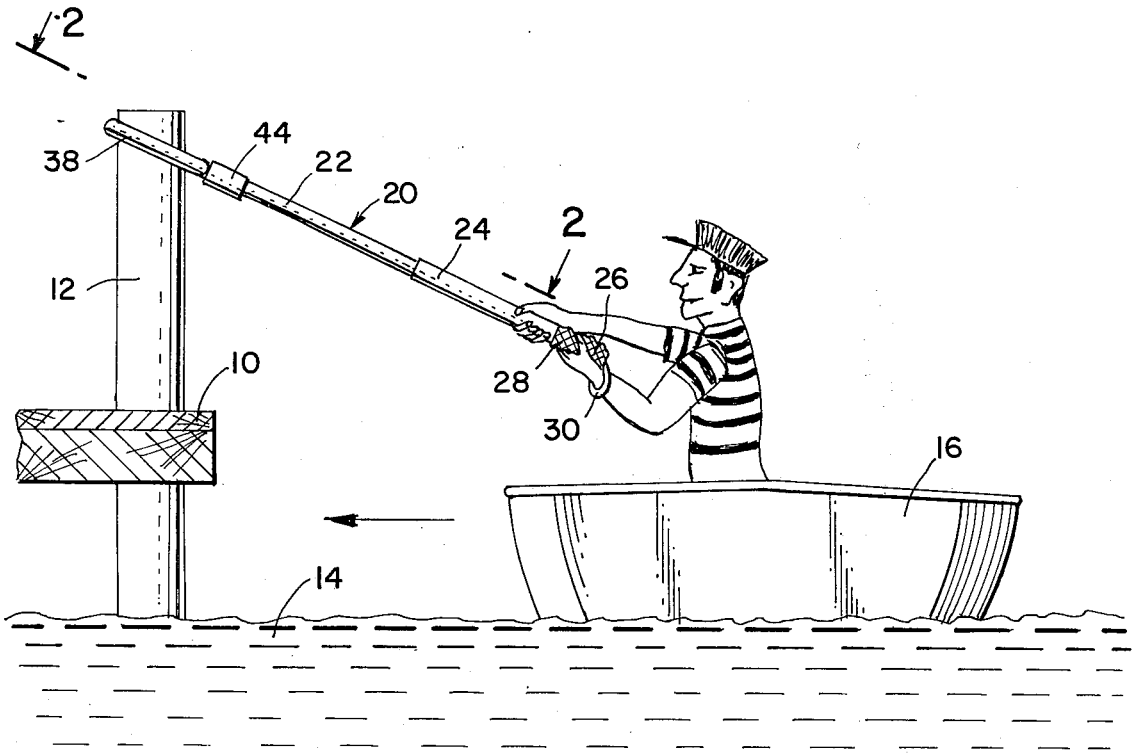
FIG. 1 is a side view of a boat being moored by means of the device of the invention, to a docking slip in a marina.

In order to understand clearly the nature of the invention, and the best means for carrying it out, reference may be had to the drawings, in which like numerals denote similar parts throughout the several views.

As shown, there is a docking slip or pier 10 which is tied to upright mooring posts 12 which are sunk and buried at their bottom ends in the ground under the water 14. The posts 12 are of sufficient length as to stick out of the water both at low and high tides, and the docking slip may be supported by floats, so that it rises and falls with the tide while the posts remain stationary.

When the boat 16, which may be a rowboat, scull, sailboat, or motor powered cabin cruiser, approaches the dock, it is important to prevent it from crashing into the dock or other boats in the slip area, especially when the weather is bad and there are winds and waves to throw the boat about. For this purpose, I provide an elongated pole device 20 which is formed of telescoping tubular piping sections 22 and 24 or further sections to provide the proper length, and in which the rearward hand-held pole section 24 has a hollow tubular handle grip portion 26 secured thereto by adhesive or frictional engagement.

The handle grip 26 may be made of rubber, plastic or other material, including cork, for a good grip and may have undulations 28 formed therein for engagement by the fingers of the hand. It may be of any suitable length for use of one or both hands thereon, and may be made of material such as cork or styrofoam which floats, so that the pole device 20 will not sink if it falls into the water, and a wrist loop 30 may also be attached to the handle grip to hold it against dropping.

The extension section 22 has an end flange 32 which fits inside the bore 33 in the base section 24, and which is retained by the end flange 34 on the outer end of the base section. While a friction fit of the parts may be enough for light boats and in calm weather, it may be desirable to provide a removable bolt 35 which fits through a hole or holes in the base tubular section 24, and is insertable through any one of a series of spaced holes through the tubular extension sections 22 to allow for making the entire device of the desired length. A string or wire may be attached to the eye of the bolt and to the base section 24, or the handle to guard against losing the bolt.

Figure 2:
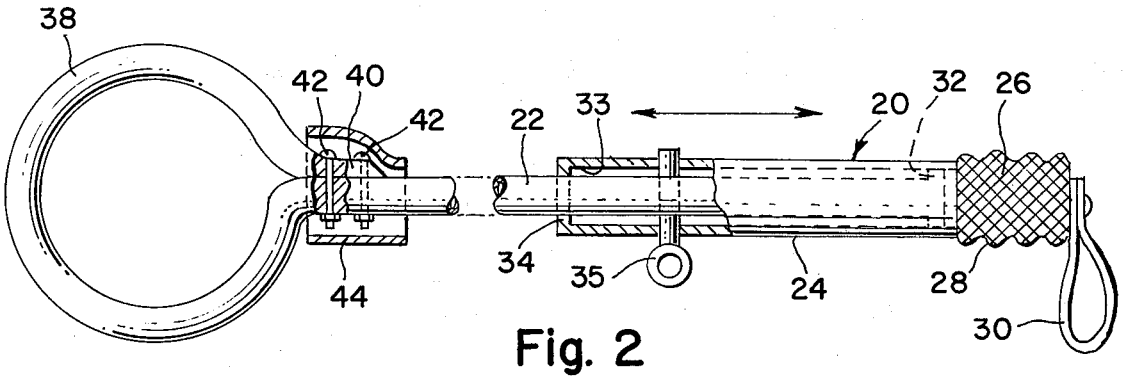
FIG. 2 is a plan view taken substantially on viewing plane 2—2 of FIG. 1, and partly broken out to show the construction.

For engaging the mooring posts 12 or the fixed object, or even a part of another boat to avoid crashing into it, an end loop 38 is bent out of the outer end of the extension section 22, and is of sufficient inside diameter to fit over the mooring posts 12 to be encountered by the boat. It may be made of the same material as the extension tube 22, such as aluminum, iron, brass, or a strong plastic tubing, and has one end 40 bent back over the shank of extension 22, and secured thereto by bolts 42 as shown best in FIG. 2. A protective collar cover 44 is snugly fitted over the joint thereat to protect against sharp edges and this may also be made of strong plastic material, canvas or the like.

Where the mooring posts 12 may be of greater diameter than the loop 38, the bolts 42 may be made longer than shown, and using wing nuts to permit of loosening them up by hand, to increase the diameter of the loop. While only one extension tube 22 is shown, it is understood that there may be several telescoping such extensions for extending to greater distances, and also where the top of the mooring post is quite high, such as at low tides.

Although the invention has been described in specific terms, it is understood that various changes may be made in size, shape, materials and arrangement without departing from the spirit and scope of the invention as claimed.

What is claimed is:

1. A boat docking and mooring aid device comprising a main elongated base section means, at least one tubular extension means engaging said base section means and extensible therefrom, said main elongated base section means comprising a hollow tubular base member having a bore formed therethrough for telescoping engagement with one of said tubular extension means closest thereto, loop means carried by the outermost one of said extension means, said loop means being capable of engaging a mooring post and other objects by a person on a boat for aiding in docking and mooring of said boat, said outermost one of said tubular extension means including an outer shank portion, said loop means comprising a rounded loop member with its outer end portion folded back and brought into engagement with said outer shank portion of said outermost one of said tubular extension means to form a hollow rounded post engaging neck portion, handle grip means carried on said main base section for being gripped by the hands of a crew member on the boat, bolt means jointly engaging said outer end portion of said loop member and the adjacent outer shank portion of said outermost tubular extension means for holding them securely together, protective cover means for fitting over said outer end portion of said loop member and said outer shank portion of said outermost tubular extension means, and said bolt means comprising a plurality of bolts of substantial length and nuts for adjusting their length to allow for adjustment of the diameter of said loop member to fit various sizes of mooring posts.

2. A boat docking and mooring aid device in accordance with claim 1, and wherein said handle grip means comprises a handle of substantial length secured to said main base section, said handle grip means being formed of lightweight floatable material so that it will sustain the mooring aid device against sinking if dropped into the water, and wrist loop means carried by said handle for engagement securely with the wrist of the crew man for guarding against accidental dropping of the mooring aid device.

3. A boat docking and mooring aid device in accordance with claim 1, wherein said main base section means has at least one pair of diametral first holes formed therethrough, said tubular extension means have a plurality of spaced diametral second holes formed therethrough, and bolt members insertable through said first and second diametral holes for adjusting the overall length of said mooring aid device.

* * * * *